United States Patent [19]

Volkert et al.

[11] 4,189,895

[45] Feb. 26, 1980

[54] METHOD AND APPARATUS FOR MAKING ENVELOPE ASSEMBLIES

[75] Inventors: John K. Volkert, Northfield; Robert B. Volkert, Wilmette, both of Ill.

[73] Assignee: Compak Systems, Inc., Northfield, Ill.

[21] Appl. No.: 861,289

[22] Filed: Dec. 16, 1977

[51] Int. Cl.[2] ..... B65B 63/04; B65B 11/48

[52] U.S. Cl. ..... 53/429; 53/435; 53/460; 53/117; 53/520; 53/206

[58] Field of Search ..... 53/31, 23, 21 FW, 206, 53/209, 117, 123, 429, 435, 460, 520; 93/62, 63 M, 63 R; 270/21; 282/25; 83/435.2

[56] References Cited

U.S. PATENT DOCUMENTS

| | | | |
|---|---|---|---|
| 3,053,291 | 9/1962 | Meissner et al. | 83/435.2 |
| 3,260,029 | 7/1966 | Kubick | 53/460 |
| 3,286,435 | 11/1966 | Weinberger | 53/117 |
| 3,336,726 | 8/1967 | Mayer et al. | 53/206 |
| 3,457,696 | 7/1969 | Berkley | 53/460 |
| 3,557,519 | 1/1971 | Lyon, Jr. | 93/63 M |
| 3,593,485 | 7/1971 | Stovall | 53/460 X |
| 3,618,284 | 11/1971 | Gendron | 53/21 FW |
| 3,628,304 | 12/1971 | Hornung | 53/460 |
| 3,672,703 | 6/1972 | Jay | 282/25 |
| 3,718,277 | 2/1973 | Vorkert | 282/25 X |
| 3,743,273 | 7/1973 | Katz et al. | 93/61 R X |
| 3,845,098 | 11/1974 | Schoue | 53/31 X |
| 3,894,905 | 7/1975 | Ecischeid | 93/63 M X |
| 3,998,138 | 12/1976 | Walters | 53/31 X |
| 4,039,122 | 10/1975 | Johnsen | 229/69 |
| 4,063,398 | 12/1977 | Huffman | 53/31 |
| 4,067,171 | 1/1978 | Herbert et al. | 53/31 |
| 4,071,997 | 2/1978 | Gunther et al. | 53/520 X |

FOREIGN PATENT DOCUMENTS

| | | | |
|---|---|---|---|
| 2112963 | 10/1972 | Fed. Rep. of Germany | 93/63 M |

*Primary Examiner*—John Sipos

*Attorney, Agent, or Firm*—Fitch, Even & Tabin

[57] ABSTRACT

An envelope contains a separate enclosure that is formed from the same sheet material. Sheet material having a first portion and a narrower second portion is folded so portions are superimposed one upon the other. At some time, adhesive is applied to the wider regions of the first portion. By severing the sheet material along the edge common to the first and second portions while maintaining their superimposed relationship, they are separated and then subsequently folded so the first portion envelops the second portion, and the envelope is produced as a result of the adhesive. The severing is carried out while the superimposed portions are suitably restrained, e.g., within a buckle plate folder or within a knife-folding unit or between a pair of moving belts.

12 Claims, 13 Drawing Figures

Fig. 5.
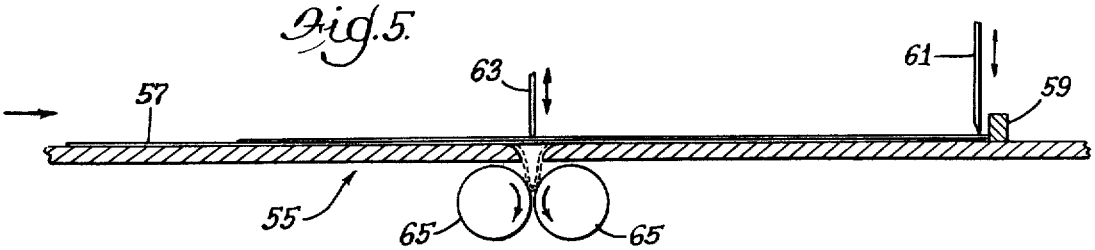
Fig. 6.
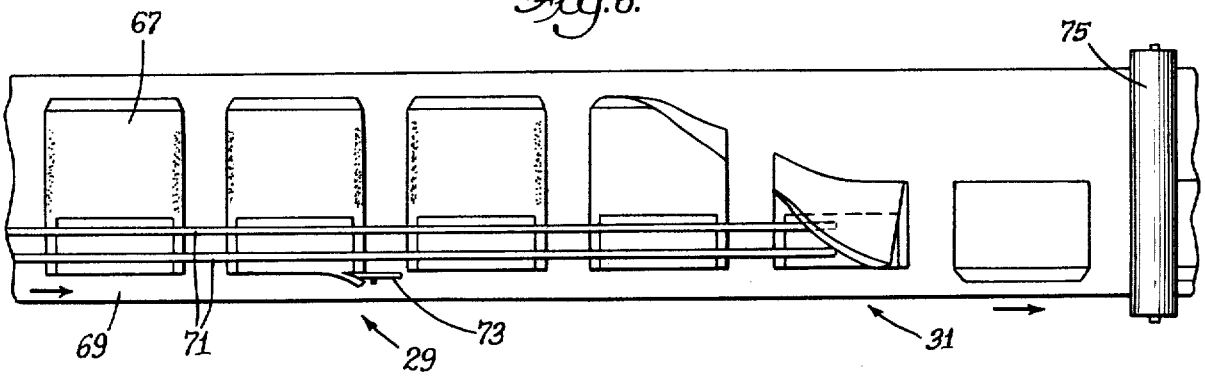
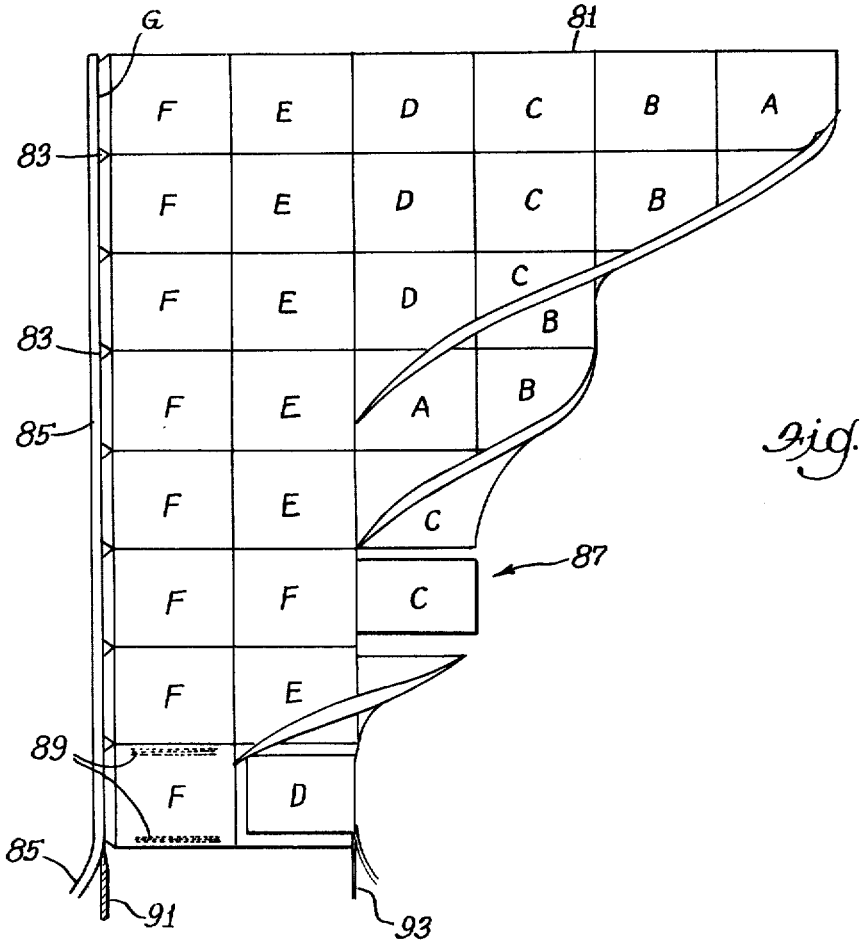
Fig. 7.

METHOD AND APPARATUS FOR MAKING ENVELOPE ASSEMBLIES

The present invention relates to the formation, from the same sheet, of an envelope plus an unattached enclosure which is contained therein. More particularly, the invention relates to methods and apparatus for producing computer-personalized pieces which include an envelope addressed to the recipient, plus a separate personalized enclosure disposed within that envelope, which enclosure may include a return envelope or reply card.

Various methods have been developed for the production-line formation of envelopes containing personalized enclosures. Examples of such prior art methods are shown in U.S. Pat. No. 3,845,698, issued Nov. 5, 1974 and in U.S. Pat. No. 3,557,519, issued Jan. 26, 1971. With the advent of more sophisticated types of impact printing and ink-jet imaging via computer-controlled devices, it has become desirable to seek improved methods and apparatus for producing such envelope-enclosure combinations from an integral piece or section of sheet material.

The present invention provides methods and apparatus for forming printed, personalized sheet material into a separate enclosure and an envelope, with the enclosure disposed in the envelope. An automated method is provided for taking pre-printed and personalized sheet material, which may be in web form or in cut-sheet form, and automatically folding, gluing and separating to produce such envelope-enclosure combinations on a mass production basis. Should an integrated operation be desired, printing and/or personalizing can be carried out as the sheet material is being converted or fabricated into the final product, all as a part of a continuous operation. Fast, efficient and relatively simple apparatus is provided for manipulating the folded enclosure and envelope portions while they are being severed from each other and for completing the formation of the envelope about the associated enclosure.

The foregoing objectives as well as other features and advantages of the invention will be apparent from the following detailed description of preferred embodiments of the invention when read in conjunction with the accompanying drawings wherein:

FIG. 5 is a perspective view of another embodiment of such apparatus;

FIG. 6 is a perspective view of still another embodiment of apparatus for severing the folded blank into separate envelope-enclosure portions; and FIG. 7 is a diagrammatic view of one method for forming pieces of this type from a continuous web of sheet material.

Figures 1, 1A, 1B, 1C, 1D, 1E, 1F, 2, 3, 4:
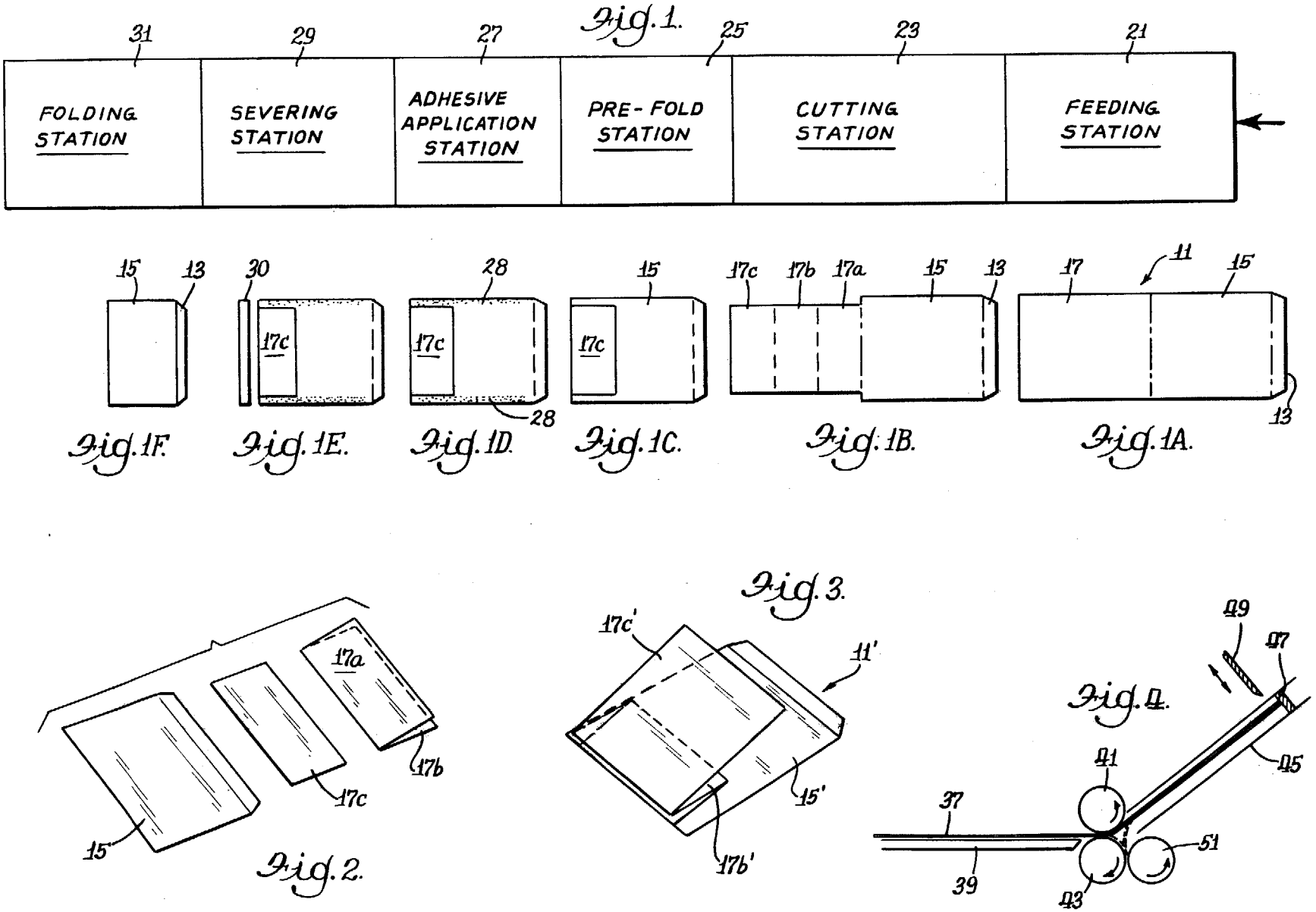
FIG. 1 is a diagrammatic view of a method embodying various features of the invention designed to take preprinted personalized sheet material and fabricate outer envelopes with separate enclosures stuffed therein.
FIGS. 1A to 1F illustrate an example of a sheet as it might progress through the stations shown in FIG. 1.
FIG. 2 is an exploded perspective view showing the piece after it has been opened by the recipient.
FIG. 3 is a perspective view of an alternative embodiment of a piece before severing has occurred.
FIG. 4 is a perspective view of one embodiment of apparatus for severing the unit into separate envelope and enclosure portions.

Illustrated in FIG. 1 is a method which is designed to operate upon preprinted sheet material which has been computer-personalized.

The sheet material can be in the form of a stack of precut blanks, or a fan-folded web that is fed through a burster, or a continous web in roll form that is fed through a sheeter. An example of a blank 11 is shown in FIG. 1A. Although a single unit blank is illustrated, it should be understood that, depending upon the width of the piece to be mailed and the available width of the fabricating equipment, two, three or more side-by-side units could be formed simultaneously. The trailing edge is cut to define what will eventually be the closure flap 13 of the envelope, and an optional print score line is shown at the location where the flap 13 joins what will be the front panel of the envelope. The blank 11 is designed to provide an envelope and an enclosure from a single piece of sheet material, usually paper, and the line of demarcation between the envelope portion 15 and the enclosure portion 17 of the blank is illustrated by a dot-dash line.

At the feeding station 21, the sheet material is fed by suitable feeding mechanism of a type appropriate for the form the sheet material is in (as discussed above) to a cutting station 23. At this station knives, which may rotate or reciprocate, trim the edges from the enclosure portion 17 of the blank 11. Such cutting mechanism is well-known in the art and may be timed to operate upon the moving blank 11 if desired. The severed portions of the blank are removed from association with the blank, so that it has the shape depicted in FIG. 1B, as it is fed to a pre-fold station 25. Alternatively, the trimming could be effected during prefolding as discussed herebelow.

The pre-fold station 25 includes a standard piece of equipment, such as a buckle-plate folder or knife folding machine. The enclosure portion 17 of the illustrated blank is designed to be folded into three panels 17*a*, 17*b* and 17*c* as indicated in FIG. 1B for purposes of explanation. An illustrative folding sequence using a buckle plate folder could be to first fold the end panel 17*c* of the enclosure portion onto the middle panel 17*b* thereof. Next, these two panels are folded onto the panel 17*a*, and finally all three panels are folded along the line of demarcation so that they are superimposed upon the envelope portion 15 of the blank 11, as depicted in FIG. 1C folded in a zig-zag arrangement. If trimming is not earlier effected, it can alternatively be carried out after the panels 17*b* and 17*c* have been folded onto the panel 17*a* and before the three panels are folded along the line of demarcation onto the envelope portion 15.

The pre-folded blank is discharged and carried to an adhesive application station 27 where an adhesive applicator applies two strips 28 of adhesive, such as a hot melt adhesive, in a pattern as generally illustrated in FIG. 1D. The adhesive pattern could be earlier applied, as during the printing operation, and then dried, in which case it would be activated at the appropriate time as by applying moisture, heat or some other appropriate energy source. Alternatively, adhesive application could be postponed and performed just prior to the final folding operation. The adhesive pattern 28 may extend to both panels of the envelope portion 15 of the blank, or it may be limited to one panel, for example, to the part of the envelope portion that will form the front panel thereof. It can be seen that, upon folding, the adhesive strips 28 will bond the envelope panels together at the side edges.

A severing station 29 is usually located immediately adjacent the adhesive application station 27, and suitable mechanism, such as a spaced belt conveyor may be used to avoid contact with the adhesive pattern of the pre-folded piece. At the severing station 29, the edge portion 30 at the line of demarcation is removed therefrom by a suitable knife as depicted in FIG. 1E. Examples of suitable severing mechanisms are illustrated in FIGS. 4 through 6 and are discussed hereinafter.

Adjacent the severing station 29 is a final folding station 31, and the automatic handling of the blank is such that the enclosure portion 17 which has now been separated from physical attachment with the envelope portion 15 is maintained in surface contact with the back panel portion of the envelope while the final folding occurs. The folding operation can be accomplished by a buckle-plate folder or by other known folding mechanisms following severing of the edge. As a result of the folding, the adhesive pattern on the interior panels of the envelope joins the two panels together to form the envelope depicted in FIG. 1F, about the folded enclosure 17 which has now also been cut into two parts as illustrated in FIG. 2.

If there are any additional materials to be added to the envelopes, they can be automatically or semi-automatically fed to a conventional stuffer and sealer. When the piece is complete, the flap, which may have a water-activated-glue pattern printed thereupon, is closed and sealed using conventional sealing equipment. Optionally, in the case where there are no further materials to be added to the envelope, an appropriate glue pattern can be applied to the flap 13 at the adhesive application station 27, and the sealing of the envelope can be effected by the folding of the flap at the final folding station 31.

FIG. 2 is an exploded perspective view showing the unit depicted in FIG. 1F after it has been opened by the recipient. It can be seen that the severing operation has created a two-piece enclosure. The panel 17*c* of the enclosure, which was originally (see FIG. 1B) the end panel, is now a separate entity and might, for example, be printed as a reply card or as an application blank. The remaining two panels 17*a* and *b* of the enclosure portion are folded upon each other and constitute the letter portion of the enclosure. Both of these are separate entities apart from the envelope itself, and upon opening of the envelope by the recipient, they are loose inside the envelope for easy removal. Instead of having the enclosure portion 17*c* be a single card, a blank 11' of greater length could be provided (see FIG. 3), and this portion 17*c'* could be formed as a reply envelope, of somewhat smaller width than the outer envelope 15'. The reply envelope could be left hinged by its closure flap to the panel 17*b'* of the enclosure portion or it could be severed therefrom, as desired. To fabricate such construction, an additional adhesive application station could be provided adjacent the cutting station 23, and the reply envelope would then be formed at the prefold station 25. Alternatively, the folding sequence might be altered so that the double panel portion 17*c'* which would form the reply envelope would be superimposed on the two panels of the main envelope portion 15' as depicted in FIG. 3. In such an instance, a double adhesive pattern would be laid down at the adhesive application station 27, and the ultimate folding operation would create both envelopes simultaneously. Overall, the method is quite versatile, and conventional folding machines can carry out any type of folding sequence desired to produce an enclosure having any reasonable number of desired panels and constituting two, three or even more separate parts, as desired.

FIG. 4 illustrates a combined severing and folding station which is created from a conventional buckle-plate folder. Buckle plate folders are standard items of commerce, and an example of one is shown in U.S. Pat. No. 4,032,133, issued June 28, 1977. In the apparatus-diagrammatically illustrated in FIG. 4, a pre-folded blank 37 with the enclosure portion superimposed upon the envelope portion (as for example shown in FIG. 1D) enters the station from the left on a conveyor belt 39. The blank 37 passes through the nip of rollers 41 and 43 and enters the buckle plate 45. An adjustable stop 47 is provided at the upper end of the buckle plate 45, and the position of the stop determines the distance the prefolded blank 37 will travel in the plate before it reverses its direction of movement and thus precisely where the folding will occur.

Immediately after the leading edge of the prefolded blank 37 hits the stop 47 (and in this instance the leading edge will be in line of the demarcation between the envelope portion and the enclosure portion), a knife 49 severs the edge portion from the remainder of the blank 37 thus separating the envelope from the enclosure or enclosures. The knife 49 is preferably a simple reciprocating blade; however, other suitable knives could be used. The severed edges are appropriately removed using air or vacuum assistance if desired. The instant the leading edge hits the buckle plate stop 47, a buckle fold, as shown in the dotted lines, is created in the region just past the nip of the rolls 41,43. This buckle fold is drawn into the nip between the rollers 43 and 51 reversing the direction of movement of the portion of the blank in the buckle plate 45 and creating the final fold that forms the outer envelope. Thus, it can be seen that, as of the instant immediately following the knife's severing the edge from the blank, the superimposed portions of the blank 37 are restrained in surface contact with each other as they are being drawn downward through the nip of the folding rollers 43,51.

Illustrated in FIG. 5 is a combined severing-folding station which utilizes a knife-folding machine 55 wherein a pre-folded blank 57 also enters from the left being moved by a suitable conveyor (not shown). An adjustable stop 59 is located near the right-hand edge, and a similar knife 61 is located adjacent the stop 59 to sever the edge therefrom. The knife 61 is preferably a reciprocating blade, and its action is essentially the same as described with respect to the buckle-plate folder shown in FIG. 4.

The instant the knife 61 finishes severing the edge portion, a folding blade 63 descends at a central location and contacts the blank 57 at a line between the front and back panels of the envelope. The blade 63 reverses the direction of movement of the portion of the blank 57 between the knife 61 and the folding blade and knocks the pre-folded blank down between a pair of folding rollers 65, as shown in dotted outline. The contra-rotating folding rollers 65 nip the sheet material and produce the folded crease between the envelope panels as the blank passes through. The adhesive pattern which has been previously employed joins the envelope panels to each other and completes the fabrication operation with the exception of the closing of the flap. The folding is effective because, the instant after the severing is effected, the superimposed envelope and enclosure portions are restrained by the descending folding blade 63 and held in surface contact with each other. In particular, the employment of such a knife-folding machine may be preferred when a blank having the general configuration depicted in FIG. 3 is employed because the folding blade 63 can be used to assure the precise location of the creases that form the bottom of both the inner and outer envelopes.

Shown in FIG. 6 is an arrangement wherein the severing station 29 is located slightly ahead of the folding station 31, and which might be a preferable way of effecting the severing and folding when the blanks remain a part of a continuous web. In this embodiment, a prefolded blank 67 is carried along upon a moving belt 69 with the enclosure portion superimposed upon the envelope portion. A pair of narrow upper belts 71 sandwich the blank against the lower belt and assure its precise position. At the severing station 29, the lower edge (FIG. 6) is removed as the pre-folded blank 67 travels past a rotary knife 73. Other suitable knife means could alternatively be employed.

After the severing is complete, the severed blank remains held in surface-to-surface contact by the belts 69 and 71 and travels to a folding station 31 where one of the envelope panels is plowed over on top of the other. Preferably, as shown in FIG. 6, the front panel is plowed over the rear panel upon which the severed enclosure is superimposed. In such an arrangement, the adhesive pattern is preferably applied to the front panel before it reaches the severing station; however it could be applied after severing but prior to the plowing. The plowed blank passes through the nip of a pair of rollers 75, and the formation of the envelope-enclosure unit is completed.

FIG. 7 diagrammatically depicts a fabrication operation for handling a preprinted, continuous web 81 of sheet material where the blanks are arranged crosswise on the web. For purposes of illustration, the various ultimate panels of the blanks are marked on the web with the letters A,B,C,D,E and F. However, it should be understood that this is done for ease of description only as the fold lines between panels are not created until the web 81 is manipulated at the various fabrication stations. In the illustrated example, the web 81 is die-cut generally along one edge to provide triangular cut-outs 83 which can either be removed or left attached to a border strip 85 which is removed at the final stage. These triangular diecuts 83 define the outer envelope flap G which is attached to the panel F.

In the illustrated folding operation, the pair of panels A,B, are first plowed over the adjacent panels C,D. When this step is completed, the superimposed panels B,C are then plowed over on top of panels D,A. Next, a die-cutting operation is carried out at a cutting station 87 so as to narrow the width of the four superimposed panels D,A, B and C. Next, the four superimposed panels are plowed onto the panel E which will form the rear panel of the envelope.

At this point there are several options. The border strip 85 along the edge of the flaps can be removed, and the blanks can be severed from one another and fed at right angles to a combination severing-folding station, such as one of those illustrated in FIGS. 3 and 5. Alternatively, an adhesive pattern 89 can be applied to the panel F, the border strip 85 removed by a knife 91 and the opposite edge removed by a knife 93. Thereafter, the folded blanks can be handled in the manner illustrated in FIG. 6 by holding the separated enclosure panels in surface contact with the panel E while the final plowing step forms the outer envelope. The envelope panels E and F can be allowed to remain part of the continuous web 81 until after the envelope is formed by final plowing, or they can be cut apart at an earlier stage, for example immediately after application of the adhesive pattern and removal of the border strip 85.

Inasmuch as the fabrication method is capable of operating on such a continuous web 81, it could directly accept the output from a web press. Thus, by combining a web press with a computer-controlled printing or imaging system and with the envelope-enclosure fabrication system described herein, a roll of blank paper can be converted directly into personalized, separate enclosures sealed within personalized outer envelopes.

Although the invention has been described with respect to certain preferred embodiments, it should be understood that various changes and modifications as would be obvious to one having the ordinary skill in this art can be made without departing from the scope of the invention which is defined solely by the claims appended hereto. Various features of the invention are set forth in the claims which follow.

What is claimed is:

1. A method of producing an envelope containing a separate enclosure both of which are formed from the same sheet material, said method comprising providing sheet material having first and second portions with said second portion being narrower than said first portion, folding said sheet material so that said second portion and said first portion are superimposed one upon the other without making any adhesive interconnections therebetween and moving said sheet material with said fold being formed at the leading edge of said sheet material, maintaining said first and second portions in substantially continuous motion from the time of said folding and then changing their direction of movement at least once, at a moment when said portions change their direction of movement separating said second portion from said first portion by severing said sheet material along the leading edge which is common to said first and second portions while maintaining said portions in said superimposed relationship without any adhesive interconnections therebetween and at said moment beginning folding said first portion about said separated second portion to envelop same while continuing to maintain said portions in said superimposed relationship and completing the folding and forming of the envelope by joining the folded wider regions of said first portion in surface contact with each other.

2. A method in accordance with claim 1 wherein said second portion is made narrower by trimming flanking regions of said sheet material just prior to said first-mentioned folding step.

3. A method in accordance with claim 1 wherein said second portion is prefolded upon itself and is then made narrower by trimming flanking regions of said sheet material just prior to said first-mentioned folding step without trimming said yet unfolded first portion of said sheet material.

4. A method in accordance with claim 1 wherein adhesive is applied to said first portion in the region where said first portion is wider than said second portion following said first folding step and prior to said subsequent folding step.

5. A method in accordance with claim 1 wherein adhesive is earlier applied to the wider regions of said first portion prior to said folding to achieve superimposed relationship, dried and later activated following said severing to effect said joinder.

6. A method in accordance with claim 1 wherein said second portion is prefolded upon itself prior to said first-mentioned folding step and wherein said second portion is itself separated into two parts at the time of said severing.

7. A method in accordance with claim 1 wherein said severing is carried out while said superimposed portions are restrained within a buckle plate folder.

8. A method in accordance with claim 1 wherein said severing is carried out while said superimposed portions are restrained within a knife-folding unit.

9. A method in accordance with claim 8 wherein said second portion overlies said first portion at the line along which said subsequent folding takes place.

10. Apparatus for producing units including an envelope and a separate enclosure contained therewithin, both of which are formed from the same sheet material, said apparatus comprising means for providing sheet material having first and second portions wherein said second portion is narrower than said first portion, means for folding said sheet material so that said second portion and said first portion are superimposed one upon the other without making any adhesive interconnections therebetween, and buckle-plate folder means for severing said sheet material along the folded edge common to said first and second portions to separate said portions from each other while maintaining said separated portions in said superimposed relationship without any adhesive interconnections therebetween and for subsequently folding said first portion about said severed second portion to envelop same while continuing to maintain said portions in said superimposed relationship while the wider regions of said first portion are being bonded to each other to create an envelope from said first portion which contains said second portion, said buckle-plate folder means including three rollers arranged adjacent one another to provide an entry nip and an exit nip, including a buckle-plate having stop means at the end thereof into which said sheet material travels after passing through said entry nip and before passing through said exit nip, and also including reciprocating knife means spaced from said stop means and located between said stop means and said rollers, whereby the severing of the folded edge is carried out by said reciprocating knife while said sheet material is in said buckle-plate and whereby the subsequent folding of said severed second portion and said first portion takes place in said exit nip of said rollers.

11. Apparatus in accordance with claim 10 wherein cutting means is provided for narrowing said second portion by removing flanking pieces of said sheet material prior to manipulation of said sheet material by said first-mentioned folding means.

12. Apparatus in accordance with claim 10 wherein means for applying adhesive to said first portion in the region where said first portion is wider than said second portion is provided at a location generally adjacent said second-mentioned folding means.

* * * * *